US007703374B1

(12) United States Patent
Dillon

(10) Patent No.: US 7,703,374 B1
(45) Date of Patent: Apr. 27, 2010

(54) MACHINE GUN TOP COVER AND SAFING BLADE ASSEMBLY

(76) Inventor: Michael J. Dillon, 8009 E. Dillon's Way, Scottsdale, AZ (US) 85260

( * ) Notice: Subject to any disclaimer, the term of this patent is extended or adjusted under 35 U.S.C. 154(b) by 439 days.

(21) Appl. No.: 11/904,237

(22) Filed: Sep. 26, 2007

(51) Int. Cl.
*F41F 1/10* (2006.01)

(52) U.S. Cl. ..... 89/12

(58) Field of Classification Search ..... 89/1.41, 89/12, 13.05

See application file for complete search history.

(56) References Cited

U.S. PATENT DOCUMENTS

| | | | | | |
|---|---|---|---|---|---|
| 3,766,821 | A * | 10/1973 | Cozzy et al. | ..... | 89/12 |
| 4,294,158 | A * | 10/1981 | Patenaude et al. | ..... | 89/12 |
| 4,841,835 | A * | 6/1989 | Bohler et al. | ..... | 89/12 |
| 5,140,892 | A * | 8/1992 | Koine | ..... | 89/7 |
| 6,742,434 | B1 | 6/2004 | Dillon | | |
| 7,013,789 | B2 | 3/2006 | Dillon | | |
| 7,441,490 | B2 * | 10/2008 | Dillon | ..... | 89/12 |
| 2006/0207418 | A1 * | 9/2006 | Burke | ..... | 89/12 |
| 2008/0092726 | A1 * | 4/2008 | Dillon | ..... | 89/12 |

OTHER PUBLICATIONS

U.S. Appl. No. 11/585,529, Michael J. Dillon.

* cited by examiner

*Primary Examiner*—Bret Hayes
(74) *Attorney, Agent, or Firm*—Bennet K. Langlotz; Langlotz Patent & Trademark Works, Inc.

(57) ABSTRACT

A top cover and safing blade assembly replaces the prior art top cover and safing sector in 7.62 miniguns. The top cover and aft camming portion of a longitudinal helical track are combined in a single unit, thus permitting the forward camming portion of the helical track, incorporated in the safing blade, to be removed separately. Safing the gun by opening the safing blade and rearming it by closing the safing blade can be accomplished in far less time than is required in prior art safing systems. Live cartridges can be quickly cleared from the minigun by electrically rotating the barrels after the safing blade has been locked in its open position.

5 Claims, 5 Drawing Sheets

SAFING BLADE
CLOSED

SAFING BLADE
OPEN

MACHINE GUN TOP COVER AND SAFING BLADE ASSEMBLY

REFERENCE TO RELATED APPLICATION

This application is related to the subject matter of U.S. patent application Ser. No. 11/585,529 entitled MACHINE GUN filed on Oct. 24, 2006, by the same inventor.

BACKGROUND AND SUMMARY OF THE INVENTION

This invention relates generally to automatic weapons of the Gatling machine gun type and, more specifically, to the class of such guns known as 7.62 miniguns and improvements therein that serve to make them easier to use by incorporating a safing blade mechanism in the top cover of such guns.

The 7.62 minigun is a six-barreled, electrically-driven machine gun originally designed and built by General Electric Company in the mid 1960's for the U.S. military. This gun has been in use since its inception by both U.S. and foreign military forces.

The 7.62 minigun, hereinafter referred to as either a minigun or machine gun, utilizes a main housing enclosing and supporting a main rotary body known as a rotor assembly. Cartridges, each of which represents a single round of ammunition, are handled within the main housing by bolt assemblies. The minigun includes six bolt assemblies, one associated with each of the six barrels. The six bolt assemblies are attached to and surround the rotor assembly. The rotor assembly comprises the core axis of the minigun. The six barrels are attached to the forward portion of the rotor assembly and are arranged for rotation as a cluster around the core axis of the minigun. As the rotor rotates, the bolt assemblies are driven forward and rearward by a helical track incorporated within the main housing which, in turn, causes cartridges to be delivered to the bolt assemblies, chambered, and fired. The empty cartridges are extracted from the chambers and ejected. The rotor is rotated by means of a series of gears driven by an electric motor.

FIGS. 1-4 depict a basic prior art top cover and safing sector assembly. The top cover and safing sector assembly is externally attached to the main housing of a minigun. The safing sector forms a portion of the helical track used to drive the minigun bolt assemblies forward and rearward. The top cover is attached to the safing sector by means of a semi-permanent retaining pin that allows the top cover to pivot independently of the safing sector. The pivot feature between the top cover and the safing sector allows the top cover to be opened and closed independently of the safing sector. The top cover opens like a hatch to allow the operator of the minigun quick access to the inner workings thereof. After the top cover has been opened, the safing sector can be either partially or completely removed from the minigun. The purpose of partially removing the safing sector is to dislocate the critical section of the helical track that causes the bolt assemblies to fire the cartridges. After the safing sector has been partially or completely removed, the minigun cannot be fired, hence the term "safing sector." Disabling the minigun so that it cannot fire is hereinafter referred to as safing the gun. Since their inception, all 7.62 miniguns have employed top covers and safing sectors of the same basic design.

There are essentially two situations in which it is desirable to safe the gun. The most common is when the minigun is loaded with live cartridges and is not in use. The second situation is when a jam occurs during use of the minigun, causing it to stop firing. In order to safe the gun in either of these situations, a conventional top cover and safing sector system requires the operator to first open the top cover to facilitate removal of the safing sector from its firing position. In a combat or training environment, safing the gun by removing both the top cover and safing sector is a time consuming and physical inconvenience.

Furthermore, when a jam occurs, the operator may be required to remove live cartridges from the rotor assembly without firing them. Doing so requires rotation of the barrels of the minigun. In order to cycle live cartridges through the minigun without firing them, the top cover and safing sector must be removed prior to rotating the barrels. Following removal of the top cover and safing sector, the barrels can be rotated manually, but not electrically. If the barrels are inadvertently rotated electrically with the safing sector in its partially or completely open position, the bolt assemblies will be damaged and the minigun will become inoperable. The barrels can only be rotated electrically when the safing sector is in its closed and firing position.

The prior art top cover and safing sector assembly described above and illustrated in FIGS. 1-4 is disadvantageous in that safing the gun requires opening of the top cover and removal of the safing sector. Simply opening the top cover does not provide improved safety or functionality. In addition, manual rotation of the hot barrels following recent use of the gun is difficult. Thus, safing a prior art minigun is at the very least inconvenient when attempting to do so in combat or training environments.

It would therefore be advantageous to provide a replacement for top cover and safing sectors of the prior art that will enable an operator to safe a minigun without opening the top cover and to rotate the barrels electrically after the minigun has been safed.

In accordance with the illustrated preferred embodiment of the present invention, a one-piece top cover and safing blade assembly replaces the prior art two-piece top cover and safing sector. The top cover and safing blade assembly is arranged to be mounted using existing locating features within the main housing of the minigun, thereby facilitating its ready adaptation to existing miniguns.

DETAILED DESCRIPTION OF THE PREFERRED EMBODIMENTS

Figure 1:
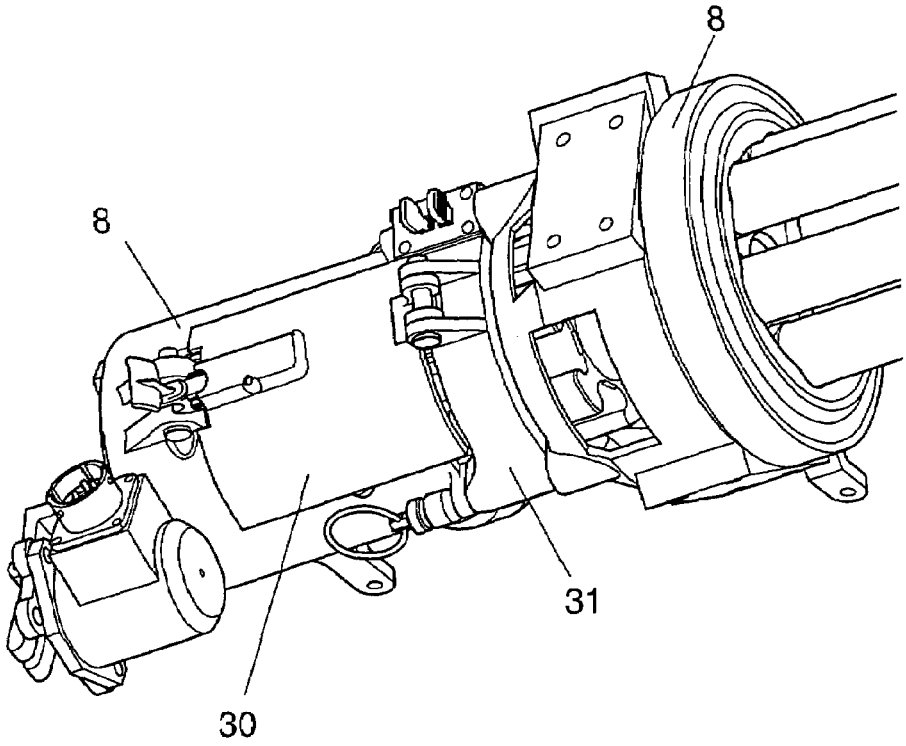
FIG 1 (PRIOR ART)
FIG. 1 is a pictorial diagram of a prior art machine gun top cover and safing sector assembly installed on a machine gun main housing.
Figure 2:
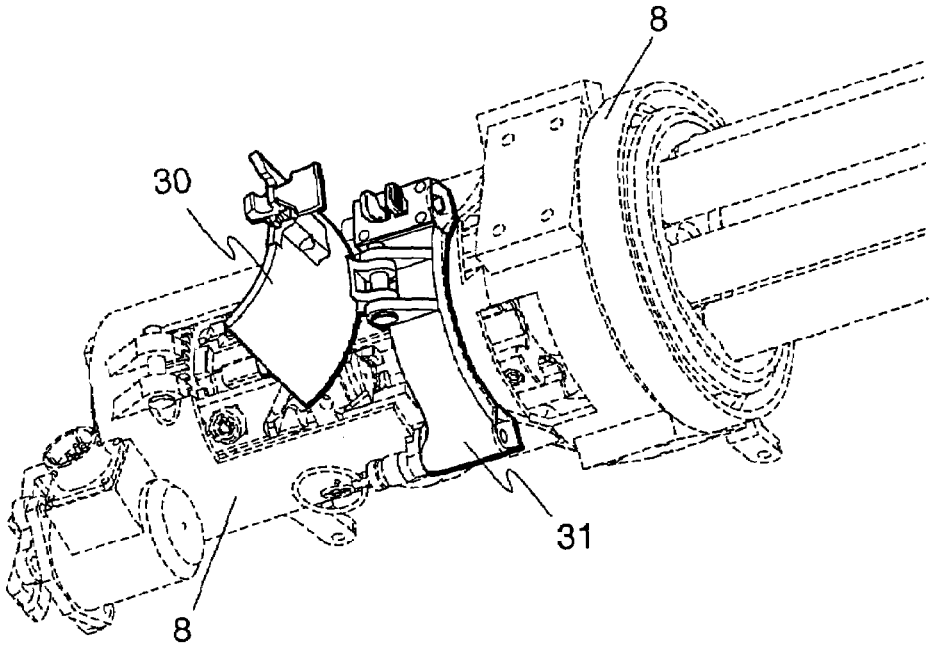
FIG 2 (PRIOR ART)
FIG. 2 is a pictorial diagram of the prior art top cover and safing sector assembly of FIG. 1, illustrating the top cover in its open position.
Figure 3:
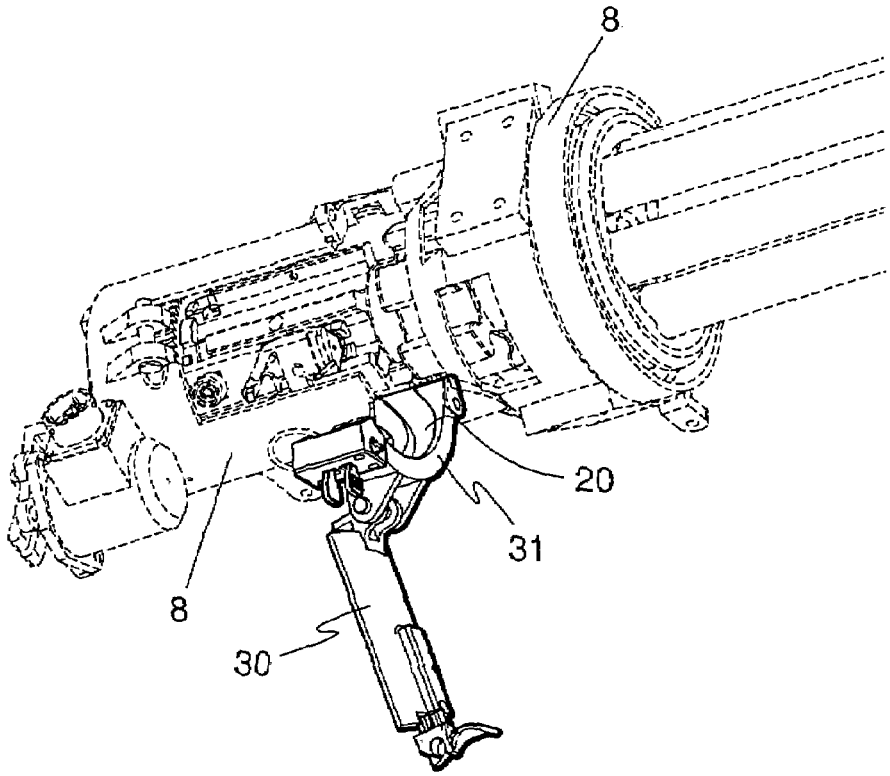
FIG 3 (PRIOR ART)
FIG. 3 is a pictorial diagram of the prior art top cover and sating sector assembly of FIG. 1, illustrating both the top cover and the safing sector in their open positions.
Figure 4:
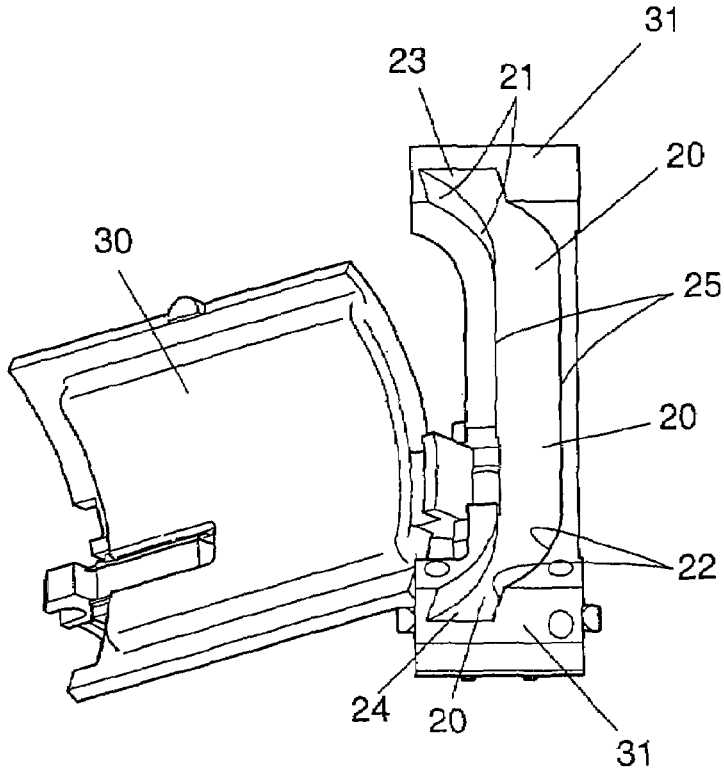
FIG 4 (PRIOR ART)
FIG. 4 is a pictorial diagram of the underside of the prior art top cover and safing sector assembly of FIG. 1, removed from the minigun main housing.

Referring generally to FIGS. 1-4, there is shown a prior art top cover 30 and safing sector 31 and the way in which they are hingedly connected adjacent each other and to a main housing 8 of a conventional minigun. As illustrated in FIGS. 3 and 4, a helical track 20 is provided in sating sector 31. Helical track 20 extends longitudinally within main housing 8. Conventional bolt assemblies include a roller bearing that rides in helical track 20. As the barrels of the minigun rotate, the bolt assemblies enter helical track 20 at location 23 of FIG. 4 and exit helical track 20 at location 24. Helical track 20 includes forward and aft camming portions 21, 22, respectively. Camming portions 21, 22 of helical track 20 are both bearing surfaces that force the bolt assemblies in forward and aft directions, respectively. A straight section of helical track 20, illustrated by sidewalls 25 of FIG. 4, serves as a guide between forward and aft camming portions 21, 22 and does not produce a camming action. As the bolt assemblies enter helical track 20 at location 23 and are forced forward by forward camming portion 21 thereof, the firing pin of each bolt assembly is placed under heavy spring pressure in preparation for firing a respective cartridge. Just prior to a given bolt assembly cresting forward camming portion 21 of helical track 20 and entering the straight section thereof defined by sidewalls 25, the cartridge is fired and the spring pressure is released. The bolt assembly continues through the straight section of helical track 20 defined by sidewalls 25 until reaching aft camming portion 22 of helical track 20, at which point the bolt assembly is forced in the aft direction, guiding the bolt assembly back into the portion of helical track 20 within main housing 8. It is forward camming portion 21 of helical track 20 that causes the cartridge to be fired and aft camming portion 22 of helical track 20 that redirects the bolt assembly and guides it back into the helical track 20 within main housing 8. When safing the gun by partially or completely removing the prior art safing sector 31, it is the removal of forward camming portion 21 of helical track 20 that inhibits the minigun from firing. In addition, when safing the gun, aft camming portion 22 of helical track 20 is also removed, further inhibiting the barrels from being rotated electrically. If the safing sector 31 is removed and the barrels are rotated electrically, the bolt assemblies will be damaged as the result of not being properly guided back into the portion of helical track 20 within main housing 8 by aft camming portion 22 of helical track 20.

Referring now generally to FIGS. 5-10, there is shown a top cover and safing blade assembly 1 in accordance with the present invention. Top cover and safing blade assembly 1 is adapted for attachment to main housing 8 of a conventional minigun and includes a top cover 2 and a safing blade 3. Top cover 2 includes a pair of side retainer pin housings 13, 14, a pair of spring-loaded retainer pins 4, 9, a pair of retainer pin springs 32, a bearing bushing 10, a latching mechanism retainer 18, and a plunger keeper 16. Spring-loaded retainer pins 4, 9 serve to attach top cover and safing blade assembly 1 to main housing 8. Retainer pins 4, 9 are spring loaded in their open or retracted position and extend through forward holes 6 of top cover 2 into locater holes in main housing 8. Top cover and safing blade assembly 1 is attached to main housing 8 by pushing the retainer pins 4, 9 forward, against the pressure applied by retainer pin springs 32, into the locator holes within main housing 8 and then locking them into the forward position by rotating a thumb tab 12, 19 of each of the retainer pins 4, 9 into their respective pin retainer notches 11. Safing blade 3 is secured by and allowed to pivot about retainer pin 4 and retainer bushing 10 through an opening 5 in safing blade 3. Safing blade 3 is secured in its closed position by a latching mechanism 17 thereof and a latching mechanism retainer 18 of top cover 2. Latching mechanism 17 is spring-loaded in its extended or locked position and is retracted by depressing a tab 7. When tab 7 is depressed, latching mechanism 17 is retracted to clear latching mechanism retainer 18 and allowing safing blade 3 to be rotated to its open position.

Figure 7:
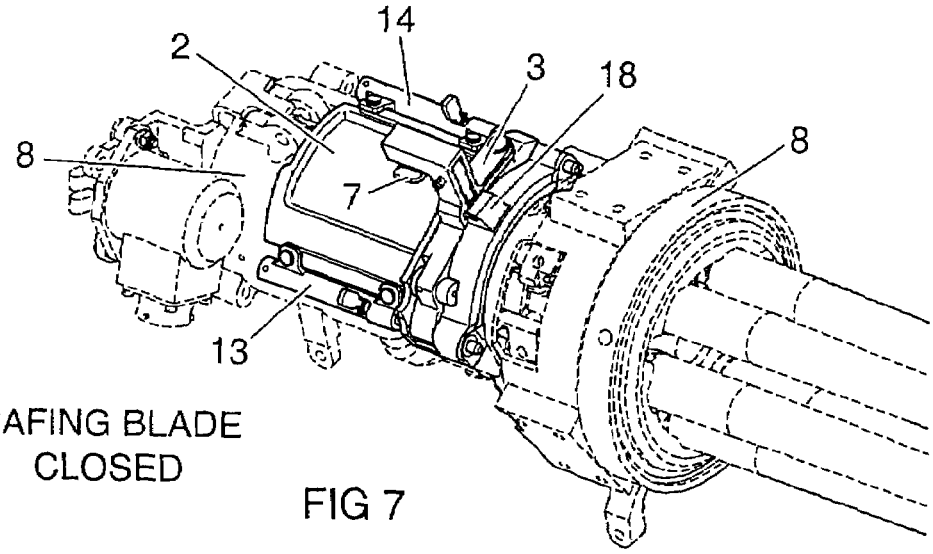
FIG. 7 is a pictorial diagram of the machine gun top cover and safing blade assembly of FIGS. 5 and 6, illustrating its installation on a machine gun main housing.
Figure 8:
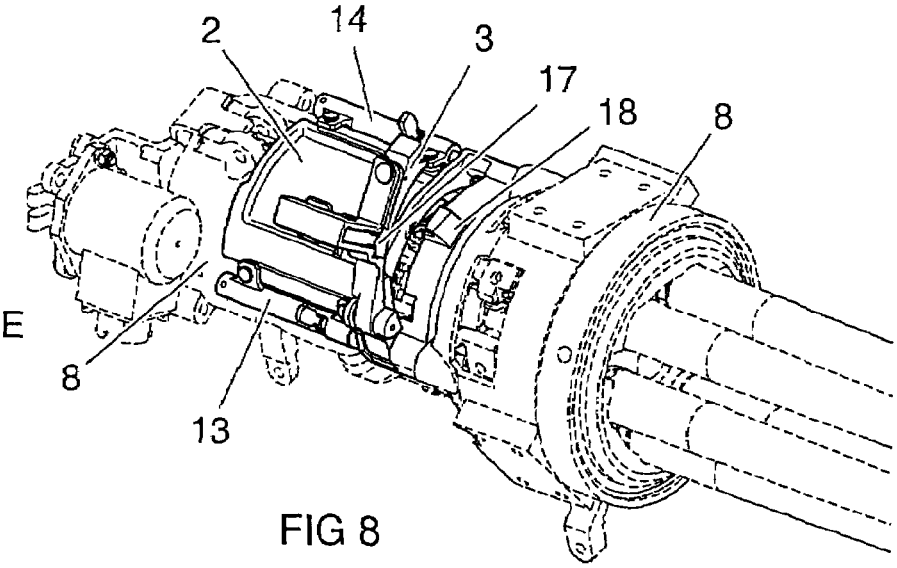
FIG. 8 is a pictorial diagram of the machine gun top cover and safing blade assembly of FIGS. 5 and 6, installed on a machine gun housing, as in FIG. 7, illustrating the safing blade in its open position.
Figure 9:
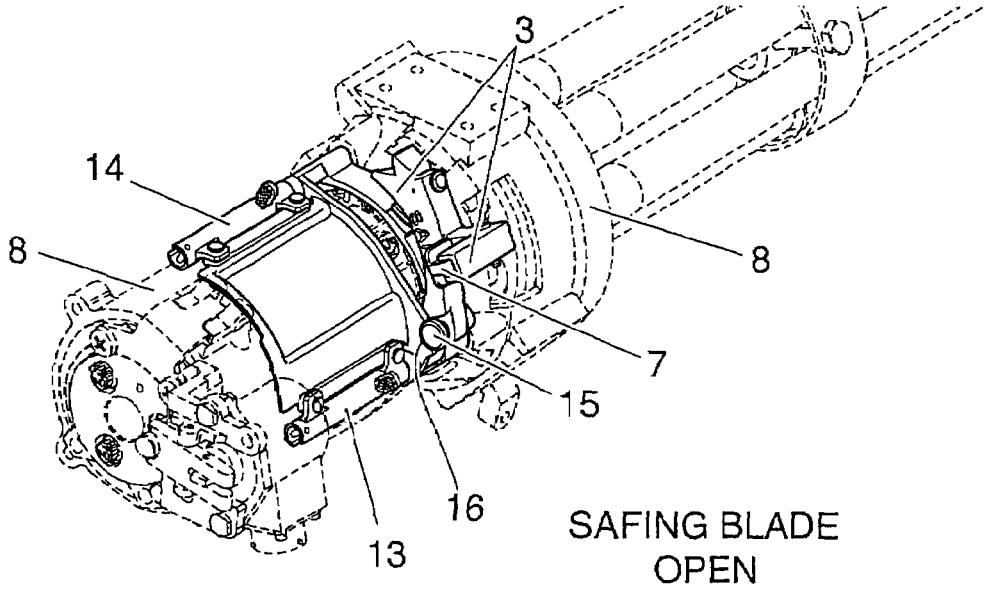
FIG. 9 is a pictorial diagram of the machine gun top cover and safing blade assembly of FIGS. 5-8, illustrating the locking mechanism that retains the safing blade in its open position.

In order to safe the gun, the safing blade 3 must be rotated from its closed position, as illustrated in FIG. 7, to its open position, as illustrated in FIGS. 8 and 9. The operator accomplishes this by depressing tab 7 and rotating safing blade 3 outward to its open position. When the safing blade 3 is fully open, a spring-loaded plunger 15, incorporated in safing blade 3, snaps into engagement with a plunger keeper 16 that is provided in top cover 2. Safing blade 3 will remain open, and the gun will remain safed until the operator depresses plunger 15 to release its engagement with plunger keeper 16 and permit rotation of safing blade 3 to its closed position. Safing blade 3 may be locked in its closed position by first depressing tab 7 or by the preferred method of rapidly rotating safing blade 3 downward to thereby force latching mechanism 17 past latching mechanism retainer 18.

Figure 5:
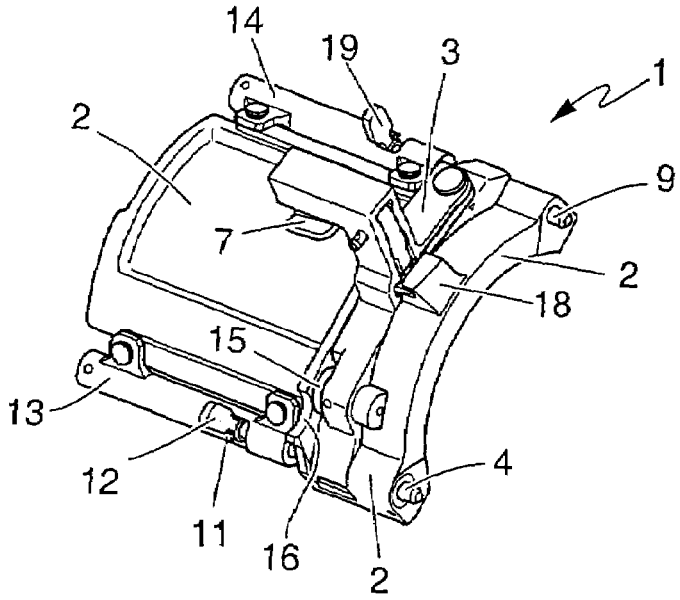
FIG. 5 is a pictorial diagram of a machine gun top cover and safing blade assembly constructed in accordance with the present invention.
Figure 6:
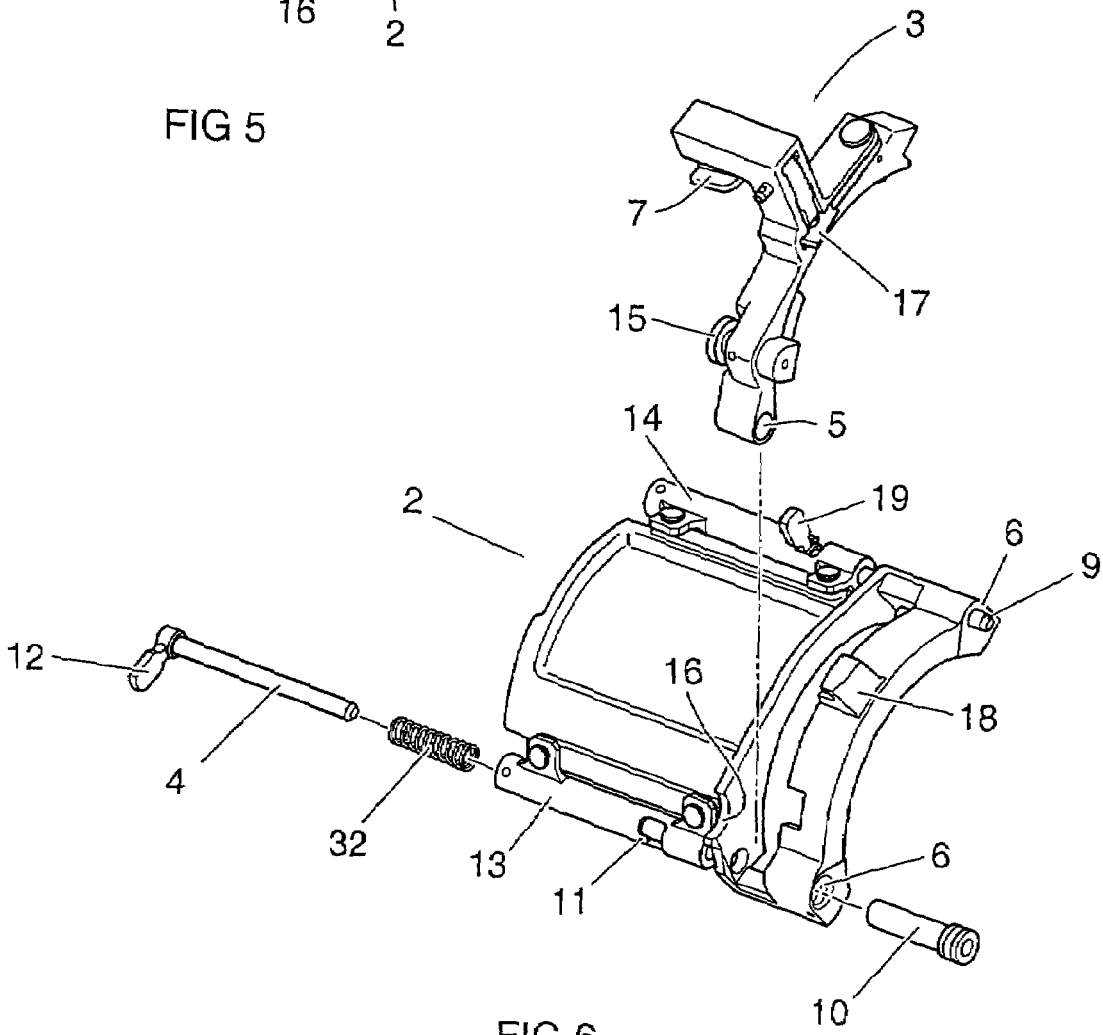
FIG. 6 is an assembly diagram of the top cover and safing blade assembly of FIG. 5.
Figure 10:
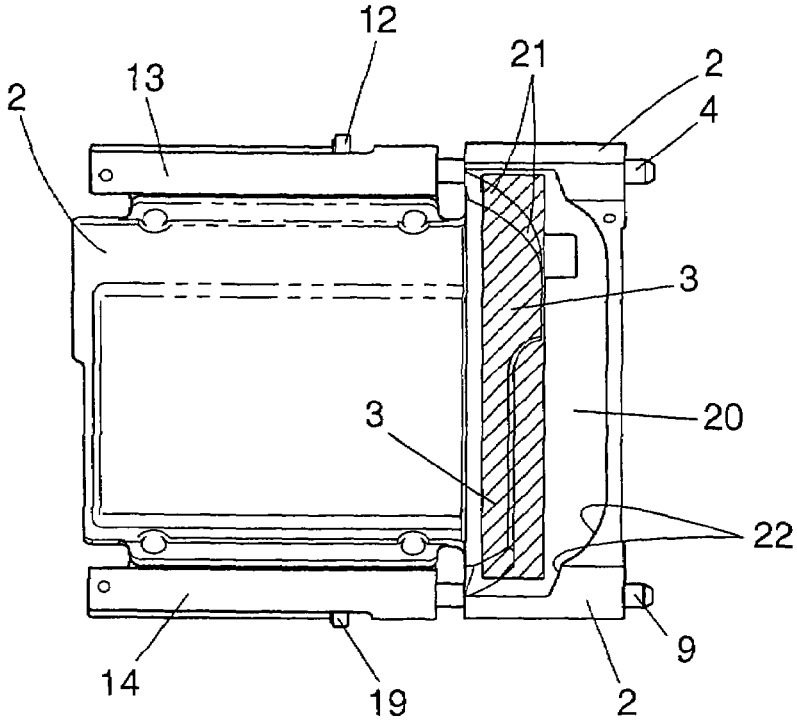
FIG. 10 is a pictorial diagram of the underside of the machine gun top cover and safing blade assembly of FIG. 5.

Referring now to FIG. 10, there is shown an underside view of top cover and safing blade assembly 1 of FIG. 5. The underside of safing blade 3 is depicted by the hatched area illustrated in FIG. 10. The geometry of forward and aft camming portions 21, 22 of helical track 20 is similar to the geometry of those same elements as depicted in FIG. 4. When safing blade 3 is in its open position or, in other words, when the gun is safed, as illustrated in FIGS. 8 and 9, forward camming portion 21 of helical track 20 is removed from the overall length of helical track 20, leaving aft camming portion 22 thereof in place. With the forward camming portion 21 of helical track 20 removed and the aft camming portion 22 retained in its operational position, the barrels of the minigun may be rotated electrically without it firing and without the bolt assemblies thereof being damaged.

In contrast to the prior art two-piece top cover 30 and safing sector 31 illustrated in FIGS. 1-4, the present invention combines the top cover 30 and aft camming portion 22 of helical track 20 into a single unit, top cover 2 of FIGS. 5-10, allowing forward camming portion 21 of helical track 20, which is incorporated in safing blade 3, to be removed separately. Safing the gun by means of opening safing blade 3 requires far less time and effort than prior art safing systems. Likewise, far less time is required to transition the minigun back to its armed and ready condition. In the event it becomes necessary for the operator to remove live cartridges from the minigun without firing them, safing blade 3 can be locked in its open position, and the minigun barrels can be rotated electrically to thereby quickly clear the minigun of live cartridges.

To remove the top cover and safing blade assembly 1 from main housing 8, thumb tabs 12, 19 of retainer pins 4, 9, respectively, are rotated out of their pin retainer notches 11 and allowed to retract, under pressure exerted by locking pin spring 32, from the locator holes within main housing 8. This permits top cover and safing blade assembly 1 to be removed in its entirety from main housing 8.

I claim:

1. A machine gun having a main housing, a rotor assembly supported by said main housing and adapted for being electrically rotated, a plurality of bolt assemblies attached to said rotor assembly, a like plurality of barrels attached to said rotor assembly, and a helical track extending longitudinally within said main housing for driving said bolt assemblies in forward and rearward directions in response to rotation of said rotor assembly, comprising:

a top cover removably attached external to a portion of said main housing, said top cover including an aft camming portion of said helical track on an underside thereof; and a safing blade removably hingedly attached to said top cover intermediate a rearward end and a forward end of said top cover, said safing blade including a forward camming portion of said helical track on an underside thereof, said safing blade being adapted for rotation, while said top cover is attached to said main housing, between a closed or armed position in which said bolt assemblies follow said forward camming portion of said helical track to facilitate firing of the gun and an open or safing position in which said forward camming portion of said helical track is removed to thereby prevent firing of the gun;

said aft camming portion of said helical track being operative, when said top cover is attached to said main housing and said safing blade is in said open position, for driving said bolt assemblies in response to electrical rotation of said rotor assembly to eject any live cartridges residing in said bolt assemblies without thereby damaging said bolt assemblies.

2. A machine gun as in claim 1, wherein:

said top cover includes a latch retainer; and said safing blade includes a spring-loaded latch mechanism positioned for engagement with said latch retainer to thereby permit said safing blade to be selectively locked in said closed position and unlocked therefrom.

3. A machine gun as in claim 1, wherein:

said safing blade includes an actuable spring-loaded plunger; and said top cover includes a plunger detent for engaging said plunger when said safing blade is rotated to said open position for releasably locking said safing blade in said open position.

4. A machine gun as in claim 1, wherein:

said top cover includes a longitudinal retainer pin housing positioned proximate left and right sides thereof, each of said retainer pin housings being adapted for removably receiving a spring-loaded, locking retainer pin that extends forwardly into a corresponding mounting opening in said main housing for removably attaching said top cover to said main housing.

5. A machine gun as in claim 4, wherein said safing blade is hingedly attached to, and rotates about, a selected one of said locking retainer pins.

* * * * *